US008844306B2

(12) United States Patent
De La Cruz et al.

(10) Patent No.: US 8,844,306 B2
(45) Date of Patent: Sep. 30, 2014

(54) HEAT EXCHANGER SUPPORT

(75) Inventors: Jose Ruel Yalung De La Cruz, Dover, PA (US); Jeffrey Lee Tucker, Wichita, KS (US); Tony Coleman, Kent (GB); John Raymond Mathias, Basildon (GB); William L. Kopko, Jacobus, PA (US)

(73) Assignee: Johnson Controls Technology Company, Holland, MI (US)

( * ) Notice: Subject to any disclaimer, the term of this patent is extended or adjusted under 35 U.S.C. 154(b) by 1646 days.

(21) Appl. No.: 12/179,984

(22) Filed: Jul. 25, 2008

(65) Prior Publication Data

US 2009/0025418 A1 Jan. 29, 2009

Related U.S. Application Data

(60) Provisional application No. 60/952,280, filed on Jul. 27, 2007.

(51) Int. Cl.

| | |
|---|---|
| ***F25D 21/14*** | (2006.01) |
| ***F28F 9/007*** | (2006.01) |
| ***F25B 40/02*** | (2006.01) |
| ***F28D 1/053*** | (2006.01) |
| ***F28F 9/02*** | (2006.01) |
| ***F28D 1/04*** | (2006.01) |
| ***F25B 40/00*** | (2006.01) |

(52) U.S. Cl.

CPC ..... *F25B 40/02* (2013.01); *F28F 9/007* (2013.01); *F28D 1/05391* (2013.01); *F25B 2400/13* (2013.01); *F28F 9/0202* (2013.01); *F28D 1/0408* (2013.01); *F25B 40/00* (2013.01)

USPC ..... 62/285; 165/67

(58) Field of Classification Search

CPC ..... F25D 21/14; F25D 2321/14; F25D 2321/143; F25D 2321/144; F25D 2321/146; F24F 13/22; F24F 13/30; F24D 21/14; F24D 2321/146; F24D 13/22; F24D 13/222; F24D 13/227

USPC ..... 62/285, 295; 165/67–69, 135

See application file for complete search history.

(56) References Cited

U.S. PATENT DOCUMENTS

| | | | | |
|---|---|---|---|---|
| 3,121,467 | A * | 2/1964 | Bryant | 180/68.4 |
| 5,174,467 | A * | 12/1992 | Sullivan | 220/571 |
| 5,279,360 | A | 1/1994 | Hughes et al. | |
| 6,260,373 | B1 * | 7/2001 | Rockwood | 62/295 |
| 2001/0040026 | A1 * | 11/2001 | Halm | 165/153 |
| 2005/0034471 | A1 * | 2/2005 | Shin | 62/285 |
| 2005/0109053 | A1 | 5/2005 | Eom et al. | |
| 2007/0169498 | A1 | 7/2007 | Rios | |
| 2007/0169925 | A1 | 7/2007 | Leman et al. | |

FOREIGN PATENT DOCUMENTS

| | | | |
|---|---|---|---|
| DE | 19859985 | A1 | 6/2000 |

* cited by examiner

*Primary Examiner* — Cassey D Bauer

(74) *Attorney, Agent, or Firm* — McNees Wallace & Nurick LLC

(57) ABSTRACT

A heating, ventilation, air conditioning and refrigeration (HVAC&R) system having a compressor, a heat exchanger, an expansion device, and a multichannel heat exchanger connected in a closed refrigerant loop. The HVAC&R system may also have a base, a retainer and/or a grommet for providing support to the multichannel heat exchanger and/or substantially isolating the multichannel heat exchanger from the base.

20 Claims, 9 Drawing Sheets

HEAT EXCHANGER SUPPORT

CROSS-REFERENCES TO RELATED APPLICATIONS

This application claims priority from and the benefit of U.S. Provisional Application No. 60/952,280, entitled MICROCHANNEL HEAT EXCHANGER APPLICATIONS, filed on Jul. 27, 2007, which is hereby incorporated by reference in its entirety into this application.

BACKGROUND

The application generally relates to a heat exchanger support and more specifically, to a support for a multichannel heat exchanger in a heating, ventilation, air conditioning and refrigeration (HVAC&R) system.

Multichannel heat exchangers may include a series of tube sections that circulate a fluid, for example, water or refrigerant. The tube sections are physically and thermally connected by fins. The fins permit airflow through the heat exchanger for heat transfer between the airflow and the circulating fluid.

Due to the thermal performance of a multichannel heat exchanger, the multichannel heat exchanger may operate at a low condensing temperature and reduce the temperature differential between the liquid refrigerant and air, thereby resulting in an efficient heat exchanging system.

A multichannel heat exchanger may be susceptible to corrosion when attached directly to a frame composed of dissimilar material, which may reduce the useful life of the multichannel heat exchanger. Separating the multichannel heat exchanger from the frame may reduce the possibility of corrosion.

SUMMARY

One embodiment of the present application relates to a heating, ventilation, air conditioning and refrigeration (HVAC&R) system having a compressor, a heat exchanger, an expansion device, and a multichannel heat exchanger connected in a closed refrigerant loop. The system also includes a base for providing support to the multichannel heat exchanger, and at least one body disposed on the base. The at least one body provides support the multichannel heat exchanger and separates the multichannel heat exchanger from the base.

Another embodiment relates to a heating, ventilation, air conditioning and refrigeration (HVAC&R) system having a compressor, a heat exchanger, an expansion device and a multichannel heat exchanger connected in a closed refrigerant loop. The system also includes a base for providing support to the multichannel heat exchanger and at least one body and at least one retainer. The at least one body and at least one retainer are disposed on the base. The at least one body supports the multichannel heat exchanger and separates the multichannel heat exchanger from the base. The at least one retainer substantially prevents a manifold of the multichannel heat exchanger from contacting the base.

Yet another embodiment relates to a heating, ventilation, air conditioning and refrigeration (HVAC&R) system having a compressor, a heat exchanger, an expansion device and a multichannel heat exchanger connected in a closed refrigerant loop. The system also includes a base for providing support to the multichannel heat exchanger and at least one body, at least one retainer, and at least one grommet. The at least one body, at least one retainer, and at least one grommet are disposed on the base. The at least one body supports the multichannel heat exchanger and separates the multichannel heat exchanger from the base. The at least one retainer substantially prevents a manifold of the multichannel heat exchanger from contacting the base. The at least one grommet substantially isolates the multichannel heat exchanger from the base.

DETAILED DESCRIPTION OF THE EXEMPLARY EMBODIMENTS

Figure 1:
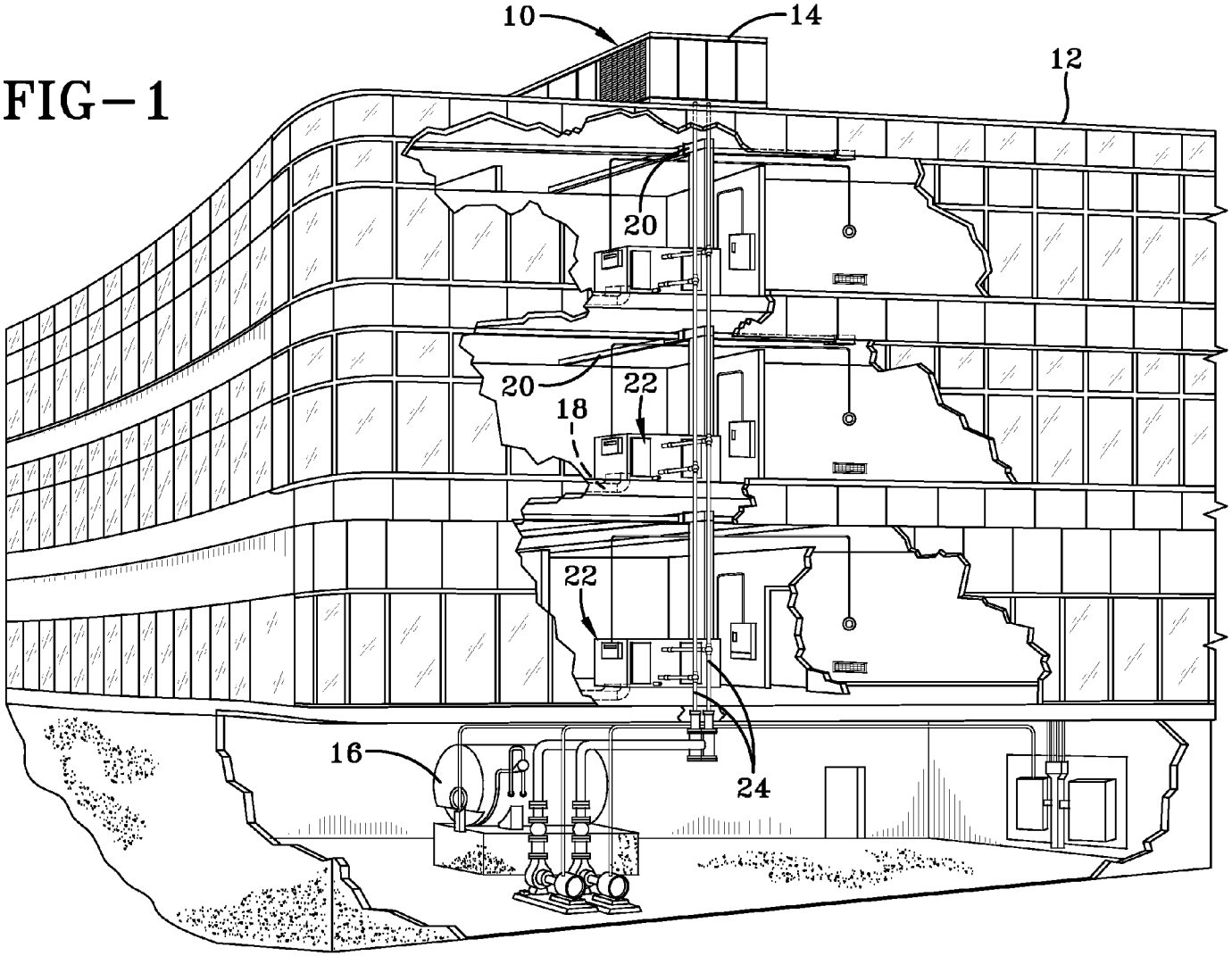
FIG. 1 shows an exemplary embodiment of an HVAC&R system in a commercial environment.

Referring to FIG. 1, an exemplary environment for an HVAC&R system 10 in a building 12 for a typical commercial setting is shown. HVAC&R system 10 may include a compressor incorporated into a rooftop unit 14 that may supply a chilled liquid that may be used to cool building 12. HVAC&R system 10 may also include a boiler 16 to supply a heated liquid that may be used to heat building 12, and an air distribution system that circulates air through building 12. The air distribution system may include an air return duct 18, an air supply duct 20 and an air handler 22. Air handler 22 may include a heat exchanger (not shown) that is connected to boiler 16 and rooftop unit 14 by conduits 24. The heat exchanger (not shown) in air handler 22 may receive either heated liquid from boiler 16 or chilled liquid from rooftop unit 14 depending on the mode of operation of HVAC&R system 10. HVAC&R system 10 is shown with a separate air handler 22 on each floor of building 12. Several air handlers 22 may service more than one floor, or one air handler may service all of the floors.

Figure 2:
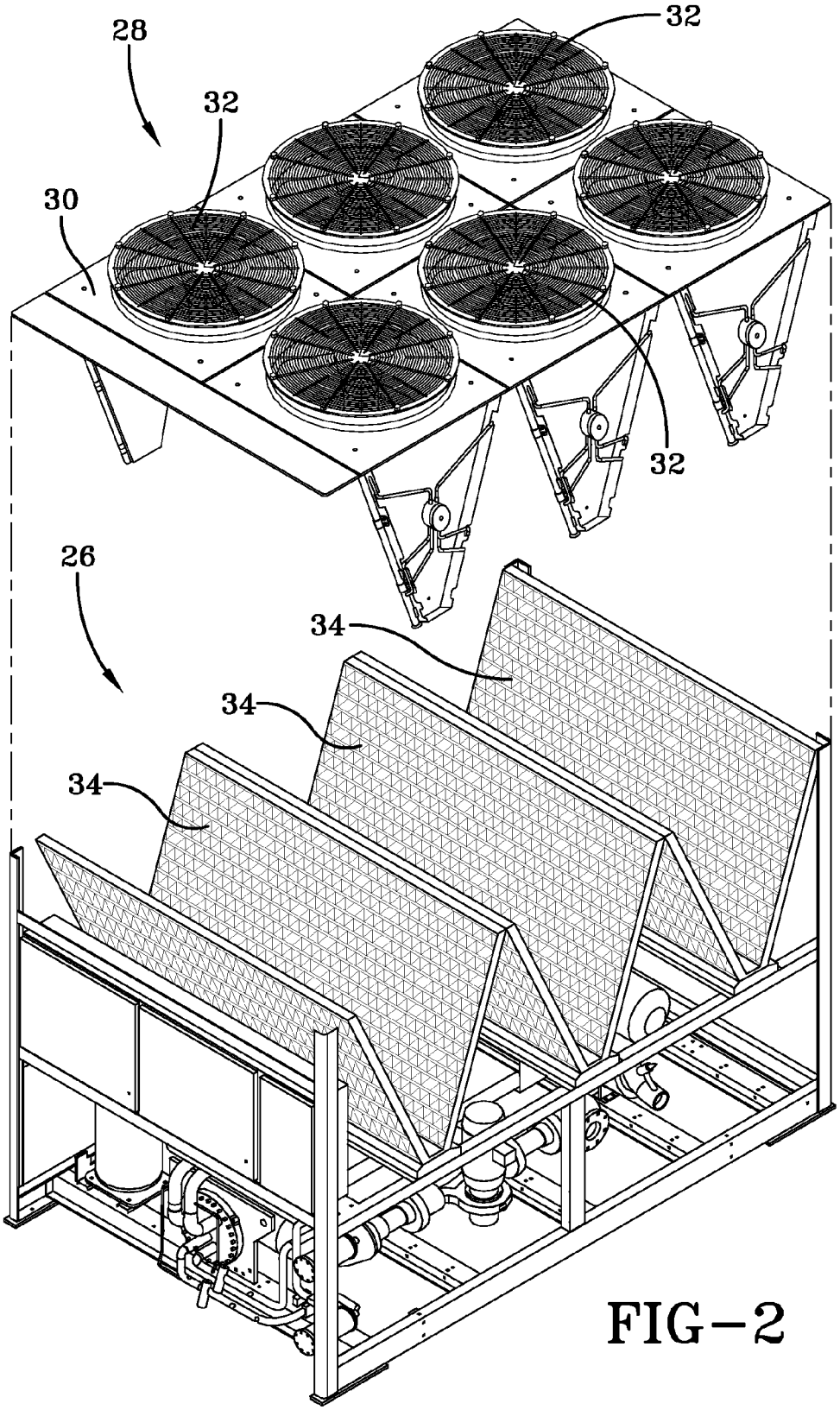
FIG. 2 shows a partially exploded view of an exemplary embodiment of a heat exchanger that may be used in the HVAC&R system shown in FIG. 1.

FIG. 2 illustrates a partially exploded view of an exemplary heat exchanger 26 that may be used in the exemplary HVAC&R system shown in FIG. 1. Heat exchanger 26 may include an upper assembly 28 including a shroud 30 one or more fans 32. The heat exchanger coils 34 may be disposed beneath shroud 30 and may be disposed above or at least partially above other system components, such as a compressor (not shown), an expansion device (not shown), and a control circuit (not shown). Coils 34 may be positioned at any angle between zero degrees and ninety degrees to provide enhanced airflow through coils 34 and to assist with the drainage of liquid from coils 34.

Figure 3:
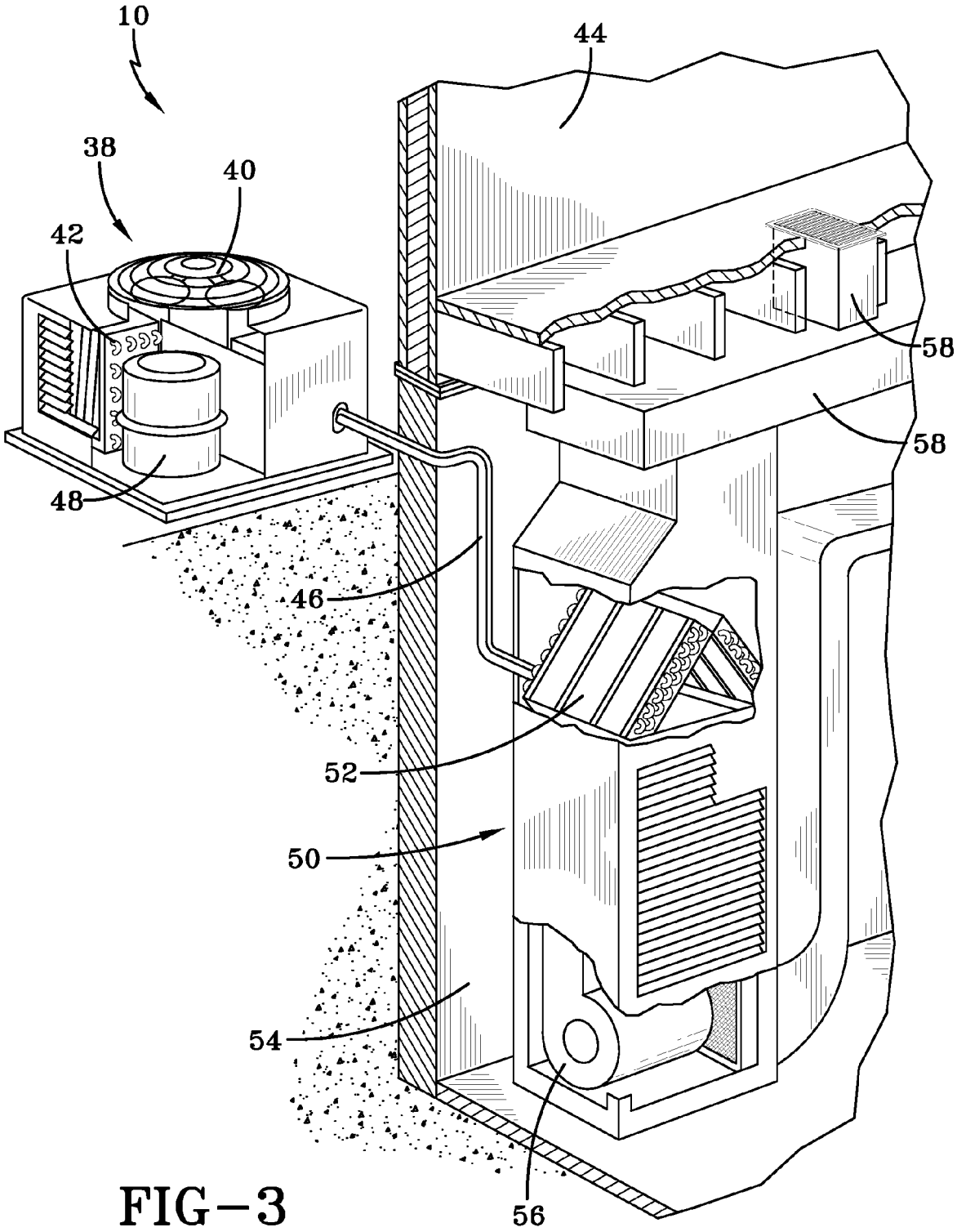
FIG. 3 shows an exemplary embodiment of an HVAC&R system in a residential environment.

Referring to FIG. 3, an exemplary environment for an HVAC&R system 10 for a typical residential setting is shown. HVAC&R system 10 may include an outdoor unit 38 located outside of a residence 44 and an indoor unit 0 located inside residence 44. Outdoor unit 38 may include a fan 40 that draws air across coils 42 to exchange heat with refrigerant in coils 42 before the refrigerant enters the residence 44 through lines 46. A compressor 48 may also be located in outdoor unit 38. Indoor unit 50 may include a heat exchanger 52 to provide cooling or heating to residence 44 depending on the operation of HVAC&R system 10. Indoor unit 50 may be located in the basement 54 of residence 44 or indoor unit 50 may be disposed in any other suitable location such as the first floor in a closet (not shown) of residence 44. HVAC&R system 10 may include a blower 56 and air ducts 58 to distribute the conditioned air (either heated or cooled) through residence 44. A thermostat (not shown) or other control may be used to control and operate HVAC&R system 10.

Figure 4:
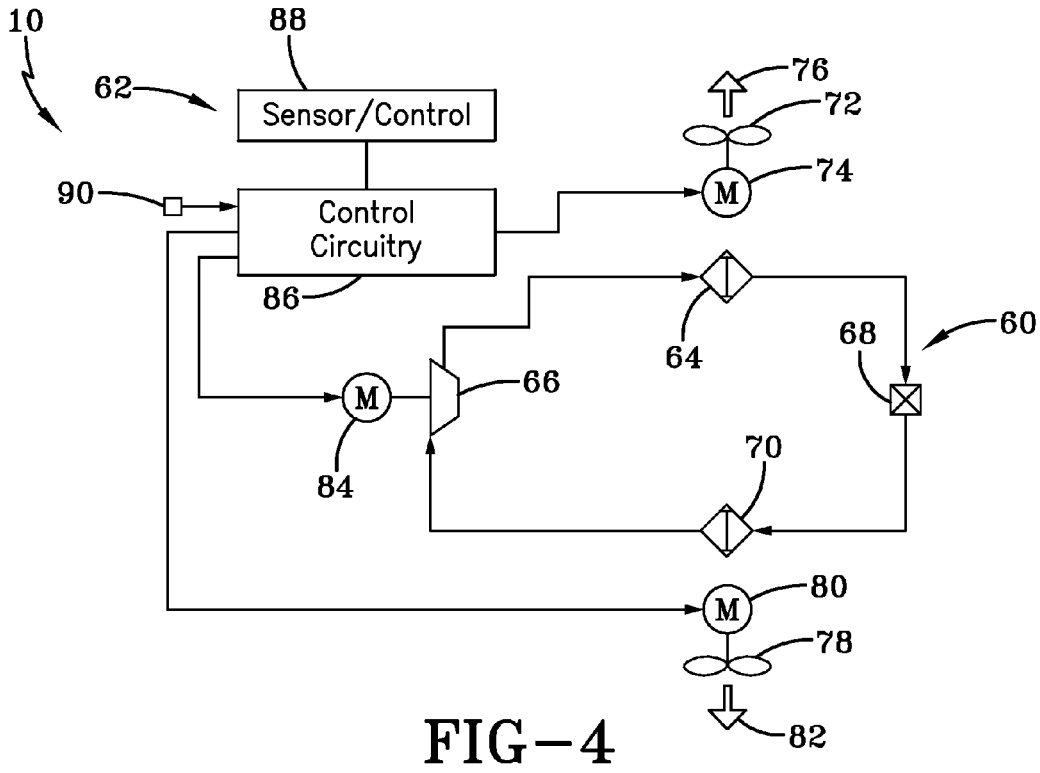
FIG. 4 schematically illustrates an exemplary HVAC&R system.

FIG. 4 illustrates an exemplary HVAC&R system 10. Refrigerant flows through HVAC&R system 10 within closed refrigerant loop 60. The refrigerant may be any fluid that absorbs and extracts heat. Some examples of fluids that may be used as refrigerants are hydrofluorocarbon (HFC) based refrigerants (for example, R-410A, R-407, or R-134a), carbon dioxide (R-744), or ammonia (R-717). HVAC&R system 10 includes control devices 62 which may enable HVAC&R system 10 during operation.

HVAC&R system 10 circulates refrigerant within closed refrigeration loop 60 through a compressor 66, a condenser 64, an electronic expansion device 68, and an evaporator 70. Compressed refrigerant vapor enters condenser 64 and flows through condenser 64. A fan 72, which is driven by a motor 74, circulates air across condenser 64. Fan 72 may push or pull air across condenser 64. The refrigerant vapor exchanges heat with the air 76 and condenses into a liquid. The liquid refrigerant then flows into expansion device 68, which lowers the pressure of the refrigerant. Expansion device 68 may be a thermal expansion valve (TXV) or any other suitable expansion device, orifice or capillary tube. After the refrigerant exits expansion device 68, some vapor refrigerant may be present along with the liquid refrigerant.

From expansion device 68, the refrigerant enters evaporator 70. A fan 78, which is driven by a motor 80, circulates air across evaporator 70. Liquid refrigerant in evaporator 70 absorbs heat from the circulated air and undergoes a phase change to a refrigerant vapor. Fan 78 may be replaced by a pump, which draws fluid across evaporator 70.

The refrigerant vapor then flows to compressor 66. Compressor 66 reduces the volume of the refrigerant vapor and increases the pressure and temperature of the vapor refrigerant. Compressor 66 may be any suitable compressor such as a screw compressor, reciprocating compressor, rotary compressor, swing link compressor, scroll compressor, or turbine compressor. Compressor 66 is driven by a motor 84, which receives power from a variable speed drive (VSD) or an alternating current (AC) or direct current (DC) power source. In an exemplary embodiment, motor 84 receives fixed line voltage and frequency from an AC power source. In some applications, the motor may be driven by a variable voltage or frequency drive. The motor may be a switched reluctance (SR) motor, an induction motor, an electronically commutated permanent magnet motor (ECM), or any other suitable motor type.

The operation of HVAC&R system 10 is controlled by control devices 62. Control devices 62 include control circuitry 86, a sensor 88, and a temperature sensor 90. Control circuitry 86 is coupled to motors 74, 80 and 84, which drive condenser fan 72, evaporator fan 78 and compressor 66, respectively. Control circuitry 86 uses information received from sensor 88 and temperature sensor 90 to determine when to operate motors 74, 80 and 84. For example, in a residential air conditioning system, sensor 88 may be a programmable twenty-four volt thermostat that provides a temperature set point to control circuitry 86. Sensor 90 may determine the ambient air temperature and provide the temperature to control circuitry 86. Control circuitry 86 may compare the temperature value received from the sensor to the temperature set point received from the thermostat. If the temperature value from the sensor is higher than the temperature set point, control circuitry 86 may turn on motors 74, 80 and 84, to operate HVAC&R system 10. Additionally, control circuitry 86 may execute hardware or software control algorithms to regulate HVAC&R system 10. Control circuitry 86 may include an analog to digital (A/D) converter, a microprocessor, a non-volatile memory, and an interface board. Other devices may be included in HVAC&R system 10, such as additional pressure and/or temperature transducers or switches that sense temperatures and pressures of the refrigerant, the heat exchangers, the inlet, and outlet air.

Figure 5:
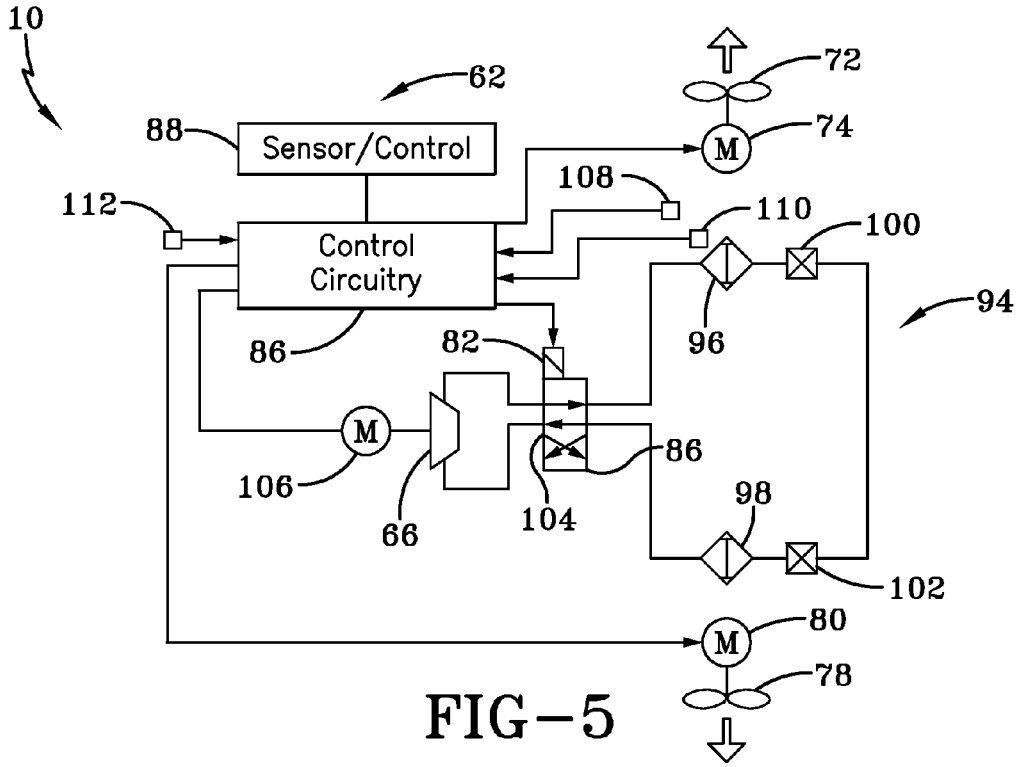
FIG. 5 schematically illustrates another exemplary HVAC&R system.

FIG. 5 illustrates an exemplary HVAC&R system 10, operating in a heat pump system capable of a heating mode of operation or a cooling mode of operation. Refrigerant flows through a reversible loop 94 in HVAC&R system 10. The refrigerant may be any fluid that absorbs and extracts heat. Additionally, operation of HVAC&R system is regulated by control devices 62.

HVAC&R system 10 includes an outdoor coil 96 and an indoor coil 98 that operate as heat exchangers. As noted above, the coils 96 and 98 may function as an evaporator or a condenser depending on the operational mode of HVAC&R system 10. For example, when system 10 is operating in a cooling (or air conditioning) mode, outdoor coil 96 functions as a condenser, releasing heat to the outside air, while indoor coil 98 functions as an evaporator, absorbing heat from the inside air. When HVAC&R system 10 is operating in a heating mode, outdoor coil 96 functions as an evaporator, absorbing heat from the outside air, while indoor coil 98 functions as a condenser, releasing heat to the inside air. A reversing valve 104 is positioned in reversible loop 94 between coils 96 and 98 to control the direction of refrigerant flow from compressor 66 and to switch HVAC&R system 10 between heating mode and cooling mode.

HVAC&R system 10 also includes two metering devices 100 and 102 for decreasing the pressure and temperature of the refrigerant before the refrigerant enters the heat exchanger operating as the evaporator. Metering devices 100 and 102 regulate refrigerant flow into the evaporator so that the amount of refrigerant entering the evaporator equals the amount of refrigerant exiting the evaporator. Metering devices 100 and 102 are used depending on the operational mode of HVAC&R system 10. For example, when HVAC&R system 10 is operating in a cooling mode, metering device 100 does not monitor the refrigerant as the refrigerant flows through metering device 100 and on to metering device 102. Metering device 102 monitors the refrigerant before the refrigerant enters indoor coil 98, which operates as an evaporator. When HVAC&R system 10 is operating in heating mode, metering device 102 does not monitor the refrigerant as the refrigerant flows through metering device 102. Metering device 100 monitors the refrigerant as the refrigerant flows from indoor coil 98 to outdoor coil 96. A single metering device may be used for both heating mode and cooling mode. Metering devices 100 and 102 typically are TXVs, but may be any suitable expansion device, orifice or capillary tubes.

In a heating mode of operation, the evaporator is outdoor coil 96 and in a cooling mode of operation, the evaporator is the indoor coil 98. Vapor refrigerant may be present in the refrigerant as a result of the expansion process that occurs in metering device 100 and 102. The refrigerant flows through the evaporator and absorbs heat from the air and undergoes a phase change into a vapor. In addition, the air passing over the evaporator may be dehumidified. The moisture from the air may be removed by condensing on the outer surface of the tubes. After exiting the evaporator, the refrigerant passes through reversing valve 104 and flows into compressor 66.

From compressor 66, the vapor refrigerant flows into a condenser. In cooling mode of operation, the condenser is the outdoor coil 96, and in the heating more of operation, the condenser is the indoor coil 98. In the cooling mode of operation, a fan 72 is powered by a motor 74 and circulates air over the condenser. The heat from the refrigerant is transferred to the outside air causing the refrigerant to undergo a phase change into a liquid. In heating mode of operation, a fan 78 is powered by a motor 80 and circulates air over the condenser. The heat from the refrigerant is transferred to the inside air causing the refrigerant to undergo a phase change into a liquid.

After exiting the condenser, the refrigerant flows through the metering device (100 in heating mode and 102 in cooling mode) and returns to the evaporator (outdoor coil 96 in heating mode and indoor coil 98 in cooling mode) where the process begins again. In both heating and cooling modes of operation, a motor 106 drives compressor 66 and compressor 66 circulates refrigerant through the reversible loop 94. Motor 106 may receive power either directly from an AC or DC power source or from a VSD.

Operation of motor 106 is controlled by control circuitry 86. Control circuitry 86 receives information from a sensor 88 and sensors 108, 110 and 112 and uses the information to control the operation of HVAC&R system 10 in both cooling mode and heating mode. For example, in cooling mode, sensor 88 may be a thermostat and may provide a temperature set point to control circuitry 86. Sensor 112 measures the ambient indoor air temperature and communicates the indoor air temperature level to control circuitry 86. If the air temperature is above the temperature set point, the HVAC&R system may operate in the cooling mode of operation. Control circuitry 86 may compare the air temperature to the temperature set point and engage compressor motor 106 and fan motors 74 and 80 to operate the HVAC&R system in a cooling mode. If the air temperature is below the temperature set point, the HVAC&R system may operate in the heating mode of operation. Control circuitry 86 may compare the air temperature from sensor 112 to the temperature set point from sensor 88 and engage motors 74, 80 and 106 to operate the HVAC&R system 10 in a heating mode.

Control circuitry 86 may use information received from sensor 88 to switch HVAC&R system 10 between heating mode and cooling mode. For example, if sensor 88 is set to cooling mode, control circuitry 86 may send a signal to a solenoid 82 to place reversing valve 104 in the air conditioning or cooling position. The refrigerant may then flow through reversible loop 94 as follows. The refrigerant exits compressor 66 and flows to outdoor coil 96, which is operating as a condenser. The refrigerant is then expanded by metering device 102, and flow to indoor coil 98, which is operating as an evaporator. If sensor 88 is set to heating mode of operation, control circuitry 86 may send a signal to solenoid 82 to place reversing valve 104 in the heating position. The refrigerant may then flow through reversible loop 94 as follows. The refrigerant exits compressor 66 and flows to indoor coil 98, which is operating as an evaporator. The refrigerant is then expanded by metering device 100, and flows to outdoor coil 96, which is operating as a condenser. Control circuitry 86 may execute hardware or software control algorithms to regulate HVAC&R system 10. Control circuitry 86 may include an A/D converter, a microprocessor, a non-volatile memory, and an interface board.

Control circuitry 86 also may initiate a defrost cycle for outside coil 96 when HVAC&R system 10 is operating in heating mode. When the outdoor temperature approaches freezing, that is, thirty-two deg. F., moisture in the outside air that is directed over outdoor coil 96 may condense and then freeze on the coil. Sensor 108 measures the outside air temperature, and sensor 110 measures the temperature of outdoor coil 96. The temperature information gathered by sensors 108 and 110 are provided to control circuitry 86, which determines when to initiate a defrost cycle for outdoor coil 96. For example, if sensor 108 or sensor 110 provides a temperature below freezing to the control circuitry, system 10 may initiate a defrost cycle for outdoor coil 96. In a defrost cycle, solenoid 82 is actuated to place reversing valve 104 to air conditioning position, and motor 74 is shut off to discontinue airflow over outside coil 96. HVAC&R system 10 operates in cooling mode until the "warm" refrigerant from compressor 66 defrosts outdoor coil 96. Once sensor 110 detects that outdoor coil 96 is defrosted by monitoring a parameter of outdoor coil 96, such as the temperature, control circuitry 86 returns reversing valve 104 to heating position. The defrost cycle may also be set to occur at various predetermined time and temperature combinations with or without relying on sensors 108 and 110.

Figure 6:
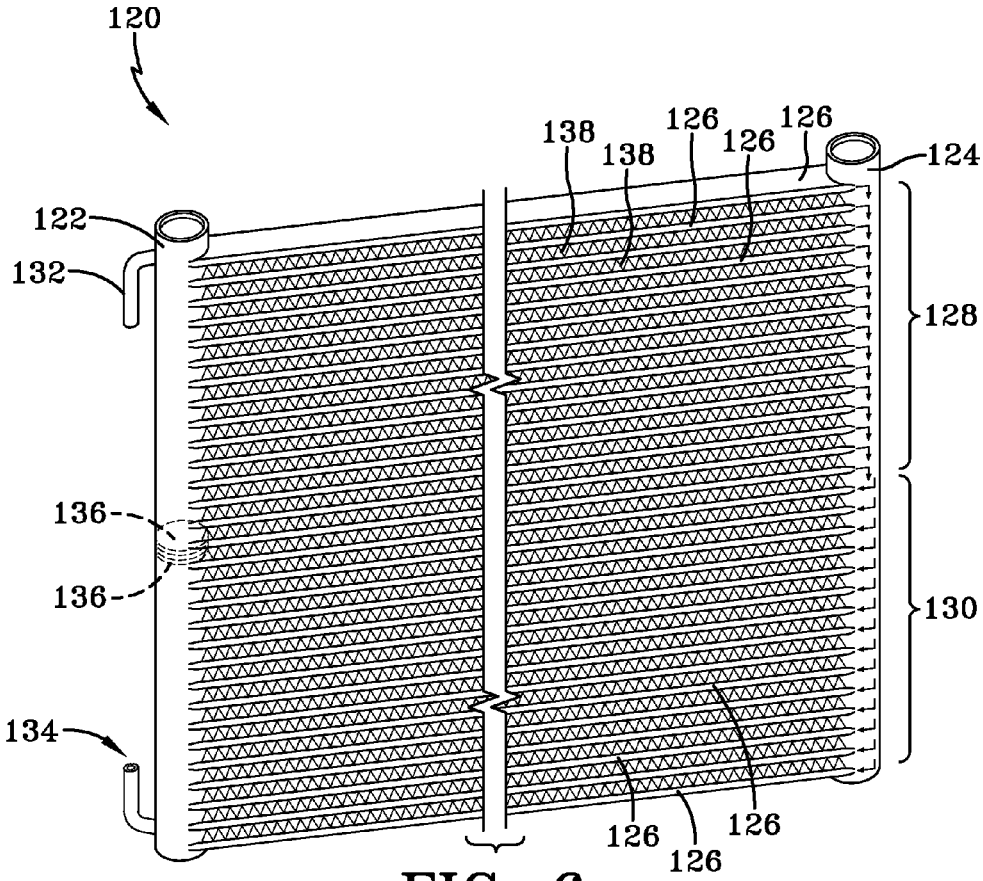
FIG. 6 shows an exemplary multichannel heat exchanger.

FIG. 6 shows an exemplary multichannel heat exchanger coil 120, which may be used in HVAC&R system 10. Multichannel heat exchanger 120 may be used in condenser 64, evaporator 70, outdoor coil 96, or indoor coil 98, as shown in FIGS. 4 and 5. Multichannel heat exchanger 120 may also be used as part of a chiller system or in any other heat exchanging application. Multichannel heat exchanger 120 includes manifolds 122, 124 that are connected by multichannel tubes 126. Although thirty multichannel tubes are shown in FIG. 6, the number of tubes may vary. Manifolds 122, 124 and tubes 126 may be constructed of aluminum or any other material that promotes heat transfer. Refrigerant flows from manifold 122 through a predetermined number of first tubes 128 to manifold 124. The refrigerant then returns to manifold 122 through a predetermined number of second tubes 130. Multichannel heat exchanger 120 may be rotated approximately ninety degrees so that multichannel tubes 126 run vertically between a top manifold and a bottom manifold. Multichannel heat exchanger 120 may be inclined at any angle. Multichannel tubes 126 are shown as having an oblong shape in FIG. 6, though tubes 126 may be any suitable shape, such as tubes with a cross-section in the form of a rectangle, square, circle, oval, ellipse, triangle, trapezoid, or parallelogram. Tubes 126 may have a width ranging from 0.5 millimeters (mm) to 3 mm. It should also be noted that multichannel heat exchanger 120 may be provided in a single plane or slab, or may include bends, corners, and/or contours.

In some embodiments, the construction of first tubes 128 may differ from the construction of second tubes 130. Tubes 126 may also differ within each section. For example, tubes 126 may all have identical cross sections, or first tubes 128 may be rectangular while second tubes 130 may be oval.

Refrigerant enters multichannel heat exchanger 120 through an inlet 132 and exits multichannel heat exchanger 120 through an outlet 134. Although FIG. 6 depicts inlet 132 at the top of manifold 122 and outlet 134 at the bottom of manifold 122, the position of inlet 132 and outlet 134 may be interchanged so that fluid enters at the bottom and exits at the top of manifold 122. The fluid may also enter and exit manifold 122 from multiple inlets and outlets positioned on bottom, side, or top surfaces of manifold 122. Inlet 132 and outlet 134 or multiple inlets and outlets may also be disposed on manifold 124 instead of manifold 122. Baffles 136 separate inlet 132 and outlet 134 on manifold 122. Although a double baffle 136 is illustrated, any number of one or more baffles 136 may be employed to create separation between inlet 132 and outlet 134.

Fins 138 are located between multichannel tubes 126 to promote heat transfer between tubes 126 and the environment. Fins 138 may be constructed of aluminum, may be brazed or otherwise joined to tubes 126, and disposed generally perpendicular to the flow of refrigerant. Fins 138 may also be made of other suitable materials that facilitate heat transfer and may extend parallel or at varying angles with respect to the flow of the refrigerant. Fins 138 may be louvered fins, corrugated fins, or any other suitable type of fin.

In an evaporator heat exchanger application, at least a portion of the heat transfer occurs during a phase change of the refrigerant. Refrigerant exits expansion device 68 (see, for example, FIG. 4) and enters evaporator 70 (see, for example, FIG. 4). As the liquid travels through first multichannel tubes 126, the liquid absorbs heat from the outside environment causing the liquid to increase in temperature. As the liquid refrigerant travels through second multichannel tubes 126, the liquid absorbs more heat from the outside environment and undergoes a phase change into a vapor. Although evaporator applications use liquid refrigerant to absorb heat, some vapor may be present in the evaporator. The amount of vapor may vary based on the type of refrigerant used in HVAC&R system 10.

FIGS. 7 through 11 show a body, such as a block 140, that isolates multichannel heat exchanger 120 from a base 142. Base 142 may be a frame or other mounting structure for the components of HVAC&R system 10. Base 142 may be constructed or manufactured from galvanized sheet metal, or other suitable material.

Figure 7:
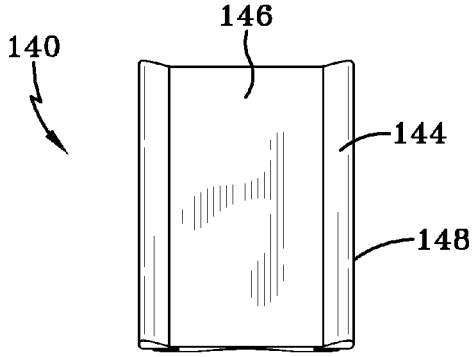
FIG. 7 shows a top view of an exemplary isolator body for a heat exchanger.
Figure 8:
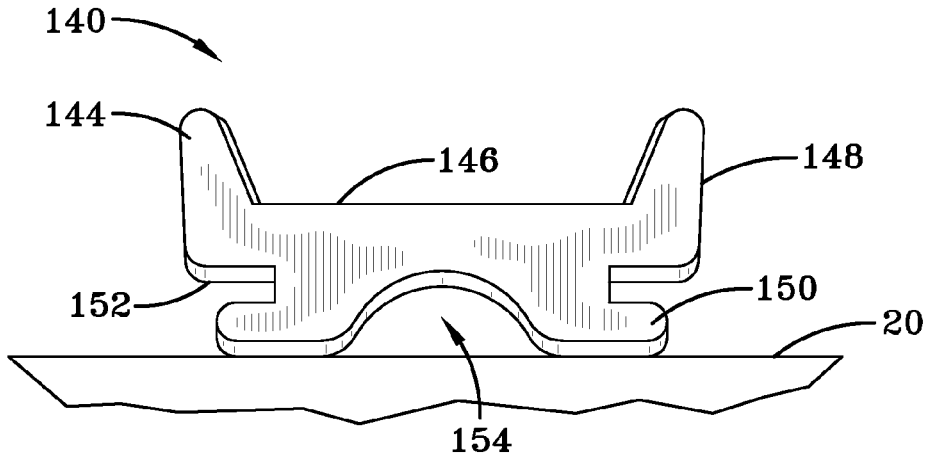
FIG. 8 shows an end view of the exemplary isolator body from FIG. 8.

In FIGS. 7 and 8, body or block 140 has a pair of sidewalls 144 along either side 148 of block 140. A substantially flat interior surface 146 extends between sidewalls 144. Sidewalls 144 project upward at a predetermined height and may have an angled shape. The predetermined height is sufficient to provide lateral support to a multichannel heat exchanger placed on interior surface 146 and prevent multichannel heat exchanger 120 from moving in a lateral direction and sliding off of block 140. Interior surface 146 is dimensioned to provide a surface wide enough to accept and support multichannel heat exchanger 120. Sidewalls 144 and interior surface 146 may form a "U" shaped channel, sufficient for accepting and supporting multichannel heat exchanger 120. Interior surface 146 may have a smooth surface, or may have a textured surface to provide a friction to help keep multichannel heat exchanger 120 in block 140. Sidewalls 144 may be equal height to one another or one sidewall 144 may have a higher predetermined height than the other sidewall 144.

Block 140 has a pair of projections, such as feet 150, extending away from the underside 152 of interior surface 146. Projections or feet 150 are located on opposite sides 148 of block 140, and define a passageway 154 for draining liquid accumulating along base 142. Passageway 154 may have a semi-circular shape, or any other suitable shape for draining accumulated liquid from the base 142. Feet 150 may have a shape similar to an "L", as shown in the figures. Feet 150 may have any suitable shape. Block 140 provides a vertical spacing between base 142 and multichannel heat exchanger 120. Feet 150 may have a textured bottom for providing a friction surface to prevent slipping or movement of the feet when multichannel heat exchanger 120 is in place.

Block 140 may be manufactured from rubber or any other suitable elastomeric and non-conductive material. Block 140 can provide electrical isolation between multichannel heat exchanger 120 and base 142. The electrical isolation reduces and/or eliminates the susceptibility of multichannel heat exchanger 120 to corrosion caused by circulating currents in base 142. Block 140 raises multichannel heat exchanger 120 to provide a drainage space for liquid from multichannel heat exchanger 120. Block 140 may include one or more tabs (not shown). The tabs may be inserted into corresponding slots (not shown) in base 142, multichannel heat exchanger 120, or both, to hold block 140 in position.

Figure 9:
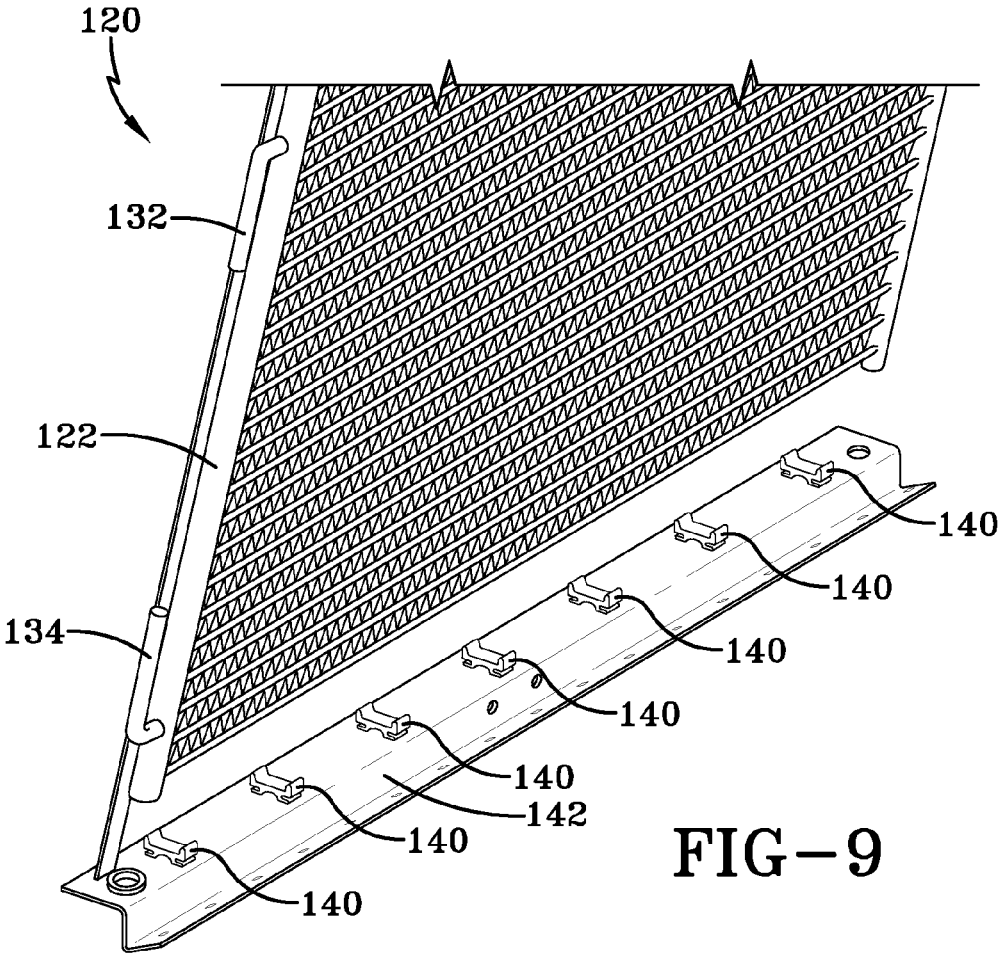
FIG. 9 shows an enlarged and partially exploded view of the exemplary heat exchanger of FIG. 2.
Figure 10:
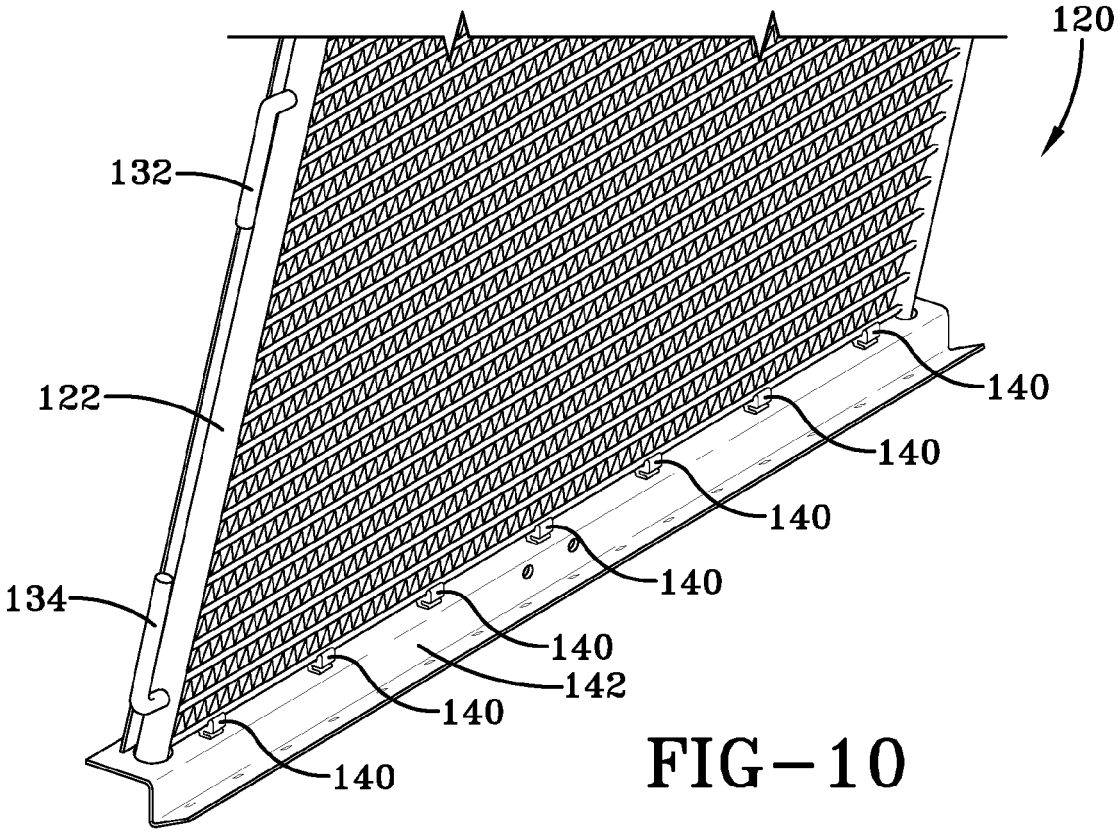
FIG. 10 shows an assembled view of the exemplary heat exchanger of FIG. 9.

FIG. 9 shows a plurality of blocks 140 mounted on base 142, before placement of multichannel heat exchanger 120 on blocks 140. FIG. 10 shows a plurality of blocks 140 supporting a multichannel heat exchanger 120 on base 142. Blocks 140 are placed on base 142 before multichannel heat exchanger 120 is set on base 142. Multichannel heat exchanger 120 is disposed on blocks 140, such that substantially no portion of multichannel heat exchanger 120 is in direct contact with base 142.

Figure 11:
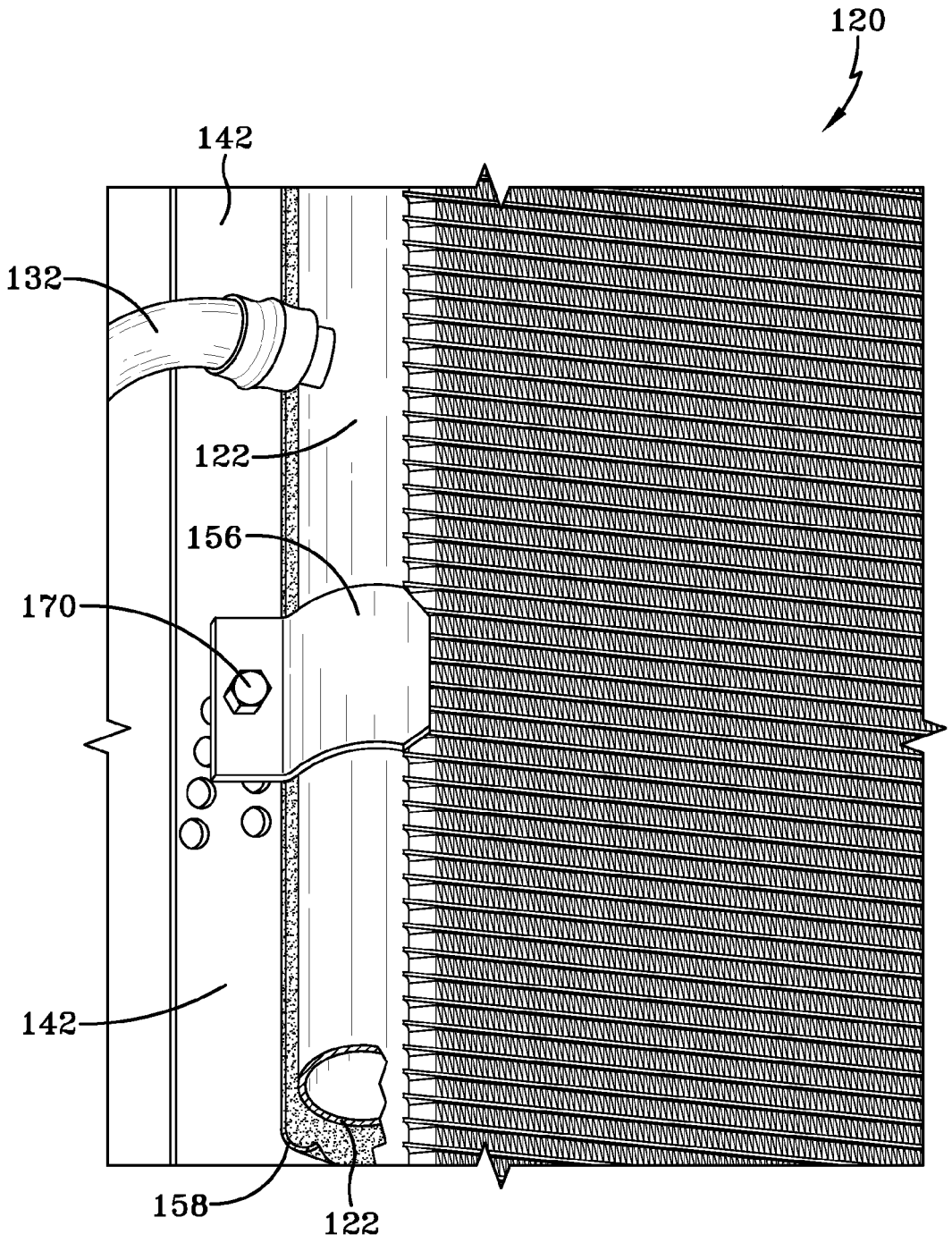
FIG. 11 shows an isolator retainer for a heat exchanger.

Referring next to FIG. 11, a retainer, such as a clip 156, may be used to isolate manifolds 122 and 124, from base 142 and provide additional support to multichannel heat exchanger. Retainer or clip 156 may have a "P" shape or any other suitable shape to isolate manifolds 122 and 124 from base 142. Clip 156 may be coated with an insulating material and may provide electrical isolation between multichannel heat exchanger 120 and base 142. Clip 156 may also accommodate thermal expansion of multichannel heat exchanger 120 during operation. Clip 156 may be secured to base 142 with a fastening device 170. Fastening device 170 may be a screw, bolt, or other suitable fastening device. In another exemplary embodiment, and adhesive or other mounting technique may be used in place of fastening device 170. Clip 156 may also be secured to manifold 122 or manifold 124 by any suitable method. Clip 156 may be dimensioned to permit manifold 122 or manifold 124 to be secured in place by friction force. A flange 158 may be located between multichannel heat exchanger 120 and base 142 to prevent multichannel heat exchanger 120 from contacting base 142 and making a thermal or electrical connection.

Figure 12:
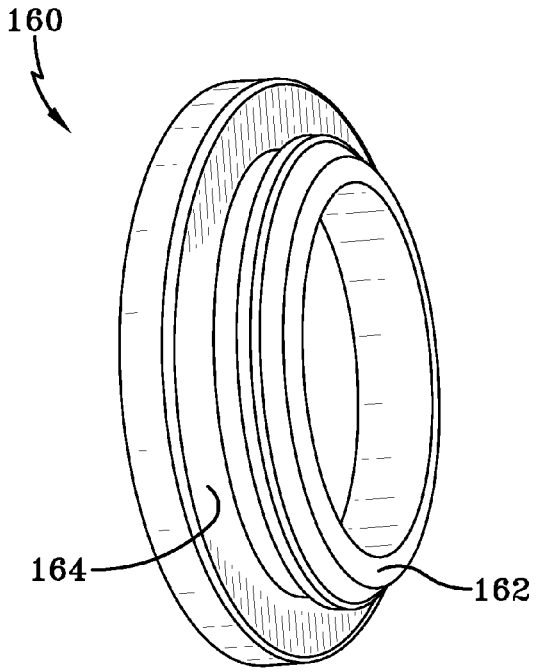
FIG. 12 shows an isolator grommet for a heat exchanger.
Figure 13:
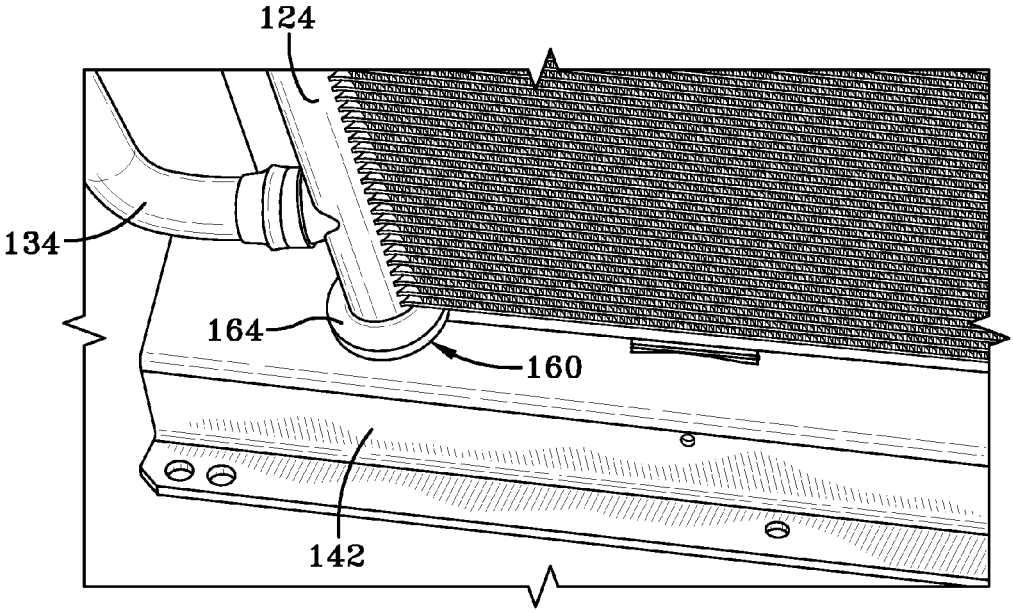
FIG. 13 shows an isolator grommet assembled with a heat exchanger.

Referring next to FIGS. 12 and 13, a grommet 160 may be used to isolate manifold 122 or manifold 124 from base 142. In exemplary embodiments, manifold 122 or manifold 124 may be extended into base 142. Grommet 160 may be shaped to accept manifold 122 or manifold 124, and has two portions. A first portion 162 fits around manifold 122 or manifold 124 and a second portion 164 rests on top of base 142. Second portion 164 may have a larger diameter than first portion 162 and may have a wider opening than first portion 162. Grommet 160 may fit securely in base 142 and manifold 122 or manifold 124 fits securely in second portion 164. When manifold 122 or manifold 124 are secured in grommet 160, neither manifold 122 or manifold 124 are in substantially contact with base 142, thus, grommet 160 isolates manifold 122 and/or manifold 124 from base 142. No additional adhesive or other similar material is necessary to hold manifold 122 or manifold 124 in place in grommet 160. More than one grommet 160 may be used to isolate both manifold 122 and manifold 124 from base 142.

While only certain features and embodiments of the invention have been illustrated and described, many modifications and changes may occur to those skilled in the art (for example, variations in sizes, dimensions, structures, shapes and proportions of the various elements, values of parameters (for example, temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the invention. Furthermore, in an effort to provide a concise description of the exemplary embodiments, all features of an actual implementation may not have been described (that is, those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heating, ventilation, air conditioning and refrigeration (HVAC&R) system comprising:

a compressor, a heat exchanger, an expansion device, and a multichannel heat exchanger connected in a closed refrigerant loop;

a base configured and disposed to provide support to the multichannel heat exchanger, the base extending between opposite ends of the multichannel heat exchanger;

a plurality of bodies positioned on the base, each body of the plurality of bodies comprising a planar surface and a pair of sidewalls projecting upward from the planar surface; and the multichannel heat exchanger being positioned on the planar surface of each body of the plurality of bodies between the pair of sidewalls, the plurality of bodies providing support for the multichannel heat exchanger and separating the multichannel heat exchanger from the base; and the pair of sidewalls being positioned on opposite sides of the planar surface and configured to prevent lateral movement of the multichannel heat exchanger on the planar surface; and at least one projection extending away from an underside of the planar surface and configured to maintain spacing between the multichannel heat exchanger and the base.

2. The HVAC&R system of claim 1, wherein the at least one projection comprises a pair of projections, the pair of projections are positioned on opposite sides of the corresponding body of the plurality of bodies and are configured to form a passageway between the pair of projections, the passageway is configured to drain accumulated fluid from the base.

3. The HVAC&R system of claim 1, wherein the plurality of bodies maintain a predetermined spacing between the multichannel heat exchanger and the base, wherein the at least one projection prevents thermal transfer of heat energy between the multichannel heat exchanger and the base.

4. The HVAC&R system of claim 1, further comprising at least one retainer to secure a side of the multichannel heat exchanger, the at least one retainer further comprising:

a rigid material formed in a predetermined shape; and a coating layer surrounding the rigid material.

5. The HVAC&R system of claim 4, wherein the predetermined shape is a "P" shape.

6. The HVAC&R system of claim 5, comprising a flange, the flange being disposed between the multichannel heat exchanger and the base and isolating the multichannel heat exchanger from the base.

7. The HVAC&R system of claim 1, further comprising at least one grommet to isolate the multichannel heat exchanger from the base, the at least one grommet further comprising:

a first portion configured to be secured in the base;

a second portion configured to secure the heat exchanger; and the first portion and second portion being of unitary construction.

8. A heating, ventilation, air conditioning and refrigeration (HVAC&R) system comprising:

a compressor, a heat exchanger, an expansion device and a multichannel heat exchanger connected in a closed refrigerant loop;

a base configured and disposed to provide support to the multichannel heat exchanger, the base extending between opposite ends of the multichannel heat exchanger;

a plurality of bodies and at least one retainer;

the plurality of bodies being positioned on the base each body of the plurality of bodies comprising a planar surface and a pair of sidewalls projecting upward from the planar surface;

the multichannel heat exchanger being positioned on the planar surface of each body of the plurality of bodies between the pair of sidewalls, the plurality of bodies providing support for the multichannel heat exchanger and separating the multichannel heat exchanger from the base; and the pair of sidewalls being positioned on opposite sides of the planar surface and configured to prevent lateral movement of the multichannel heat exchanger on the planar surface; and at least one projection extending away from an underside of the planar surface and configured to maintain spacing between the multichannel heat exchanger and the base;

the at least one retainer being positioned on the base and preventing a manifold of the multichannel heat exchanger from contacting the base.

9. The HVAC&R system of claim 8 wherein the at least one retainer further comprises:

a rigid material formed in a predetermined shape; and a coating layer surrounding the rigid material.

10. The HVAC&R system of claim 9 wherein the predetermined shape is a "P" shape.

11. The HVAC&R system of claim 10, comprising a flange, the flange being disposed between the multichannel heat exchanger and the base and isolating the multichannel heat exchanger from the base.

12. The HVAC&R system of claim 8 wherein the at least one projection comprises a pair of projections, the pair of projections are positioned on opposite sides of each body of the plurality of bodies and are configured to provide a passageway between the pair of projections, the passageway is configured to drain accumulated fluid from the base.

13. The HVAC&R system of claim 8 wherein the plurality of bodies maintain a predetermined vertical spacing between the multichannel heat exchanger and the base and the plurality of bodies prevent transfer of thermal energy between the heat exchanger and the base.

14. A heating, ventilation, air conditioning and refrigeration (HVAC&R) system comprising:

a compressor, a heat exchanger, an expansion device and a multichannel heat exchanger connected in a closed refrigerant loop;

a base configured and disposed to provide support to the multichannel heat exchanger, the base extending between opposite ends of the multichannel heat exchanger;

a plurality of bodies, at least one retainer, and at least one grommet;

the plurality of bodies being positioned on the base each body of the pluralities of bodies comprising a planar surface and a pair of sidewalls projecting upward from the planar surface;

the multichannel heat exchanger being positioned on the planar surface of each body of the plurality of bodies between the pair of sidewalls, the plurality of bodies providing support for the multichannel heat exchanger and separating the multichannel heat exchanger from the base;

the pair of sidewalls being positioned on opposite sides of the planar surface and configured to prevent lateral movement of the multichannel heat exchanger on the planar surface; and at least one projection extending away from an underside of the planar surface and configured to maintain spacing between the multichannel heat exchanger and the base;

the at least one retainer being positioned on the base and preventing a manifold of the multichannel heat exchanger from contacting the base; and the at least one grommet being positioned on the base and isolating the multichannel heat exchanger from the base.

15. The HVAC&R system of claim 14 wherein the at least one retainer further comprises:

a rigid material formed in a predetermined shape; and a coating layer surrounding the rigid material.

16. The HVAC&R system of claim 15 wherein the predetermined shape is a "P" shape.

17. The HVAC&R system of claim 15, comprising a flange, the flange being disposed between the multichannel heat exchanger and the base and isolating the multichannel heat exchanger from the base.

18. The HVAC&R system of claim 14 wherein the at least one grommet further comprising:

a first portion configured to be secured in the base;

a second portion configured to secure the heat exchanger; and the first portion and second portion being of unitary construction.

19. The HVAC&R system of claim 14 wherein the at least one projection comprises a pair of projections, the pair of projections are positioned on opposite sides of each body of the plurality of bodies and are configured to provide a passageway between the pair of projections, the passageway is configured to drain accumulated fluid from the base.

20. The HVAC&R system of claim 14 wherein the plurality of bodies maintain a predetermined spacing between the multichannel heat exchanger and the base and the plurality of bodies prevent transfer of thermal energy between the heat exchanger and the base.

* * * * *